US008990965B2

(12) United States Patent
Waldman et al.

(10) Patent No.: US 8,990,965 B2
(45) Date of Patent: Mar. 31, 2015

(54) GARMENT WITH SLIP-RESISTANT LINER

(75) Inventors: Mark Waldman, New Hope, PA (US); Jenni Saylor, Easton, PA (US); Theresa Ann McGrane, Kingston, PA (US)

(73) Assignee: Global Trademarks, LLC, Stockertown, PA (US)

( * ) Notice: Subject to any disclaimer, the term of this patent is extended or adjusted under 35 U.S.C. 154(b) by 29 days.

(21) Appl. No.: 12/715,037

(22) Filed: Mar. 1, 2010

(65) Prior Publication Data

US 2011/0209262 A1 Sep. 1, 2011

(51) Int. Cl.
*A41D 7/00* (2006.01)
*A41C 1/00* (2006.01)

(52) U.S. Cl.
CPC ..... *A41C 1/006* (2013.01); *A41B 2400/82* (2013.01)
USPC ..... 2/69

(58) Field of Classification Search
CPC .. A41B 2400/82; A41C 1/006; A41C 3/0014; A41C 3/08; A41D 1/22; A41D 2400/38
USPC ..... 2/113, 115, 118, 133, 74, 105; 450/3, 4, 450/5, 8, 10, 11, 95, 31; 66/176
See application file for complete search history.

(56) References Cited

U.S. PATENT DOCUMENTS

| | | | | |
|---|---|---|---|---|
| D59,562 | S * | 11/1921 | Merchant | D2/714 |
| 1,811,843 | A * | 6/1931 | Chisholm | 139/421 |
| 2,052,935 | A * | 9/1936 | Moran | 450/10 |
| 2,351,199 | A * | 6/1944 | Fry | 66/172 E |
| 2,579,547 | A | 12/1951 | Cadous | 2/37 |
| 3,590,823 | A | 7/1971 | Pope | 128/519 |
| 3,930,090 | A | 12/1975 | Campbell et al. | 428/196 |
| 5,359,732 | A | 11/1994 | Waldman et al. | 2/67 |
| 5,426,791 | A | 6/1995 | Sydor et al. | 2/255 |
| 5,885,910 | A | 3/1999 | Graichen | 442/101 |
| 5,921,976 | A * | 7/1999 | Seymore | 604/385.03 |
| 5,956,765 | A | 9/1999 | Chin | 2/69 |
| 6,332,825 | B1 | 12/2001 | Henricksen | 450/81 |
| 6,446,268 | B1 | 9/2002 | Lazarian | 2/255 |
| 6,871,516 | B2 | 3/2005 | Peeler et al. | 66/171 |
| 7,228,809 | B2 | 6/2007 | Angelino et al. | 112/475.08 |
| 7,395,557 | B1 * | 7/2008 | Ledyard | 2/113 |
| 7,415,734 | B2 * | 8/2008 | Donnelly | 2/106 |
| 7,422,508 | B2 | 9/2008 | Bentham | 450/86 |
| 2002/0129434 | A1 | 9/2002 | Rabinowicz | 2/69 |
| 2005/0266770 | A1 | 12/2005 | Henricksen | 450/1 |
| 2006/0021387 | A1 * | 2/2006 | Chuang et al. | 66/8 |
| 2007/0084390 | A1 | 4/2007 | Angelino et al. | 112/475.01 |

(Continued)

OTHER PUBLICATIONS

International Search Report dated Apr. 18, 2011 from corresponding PCT/US2011/024,899.

(Continued)

*Primary Examiner* — Khoa Huynh
*Assistant Examiner* — Anna Kinsaul
(74) *Attorney, Agent, or Firm* — Ohlandt, Greenley, Ruggiero & Perle, L.L.P.

(57) ABSTRACT

A garment having a liner including a tubular member having an opening at one end and an opening at an opposite end and a non-slip portion disposed proximate one of the openings. A garment having a liner including a tubular member having an upper opening at one end and a lower opening at an opposite end and sides between the upper opening and the lower opening. A non-slip portion disposed proximate the lower opening that adheres to the abdomen of the wearer.

27 Claims, 10 Drawing Sheets

(56) References Cited

U.S. PATENT DOCUMENTS

| | | | | |
|---|---|---|---|---|
| 2007/0094765 | A1 | 5/2007 | Summers et al. | 2/113 |
| 2007/0204782 | A1 | 9/2007 | Angelino et al. | 112/475.09 |
| 2008/0078208 | A1* | 4/2008 | Kronbach | 66/171 |
| 2008/0134409 | A1 | 6/2008 | Karasina | 2/117 |
| 2008/0244805 | A1* | 10/2008 | Griffin | 2/74 |
| 2008/0295227 | A1 | 12/2008 | Welsch et al. | 2/401 |
| 2008/0302460 | A1 | 12/2008 | Angelino et al. | 156/60 |
| 2009/0047481 | A1 | 2/2009 | Welsch et al. | 428/179 |
| 2009/0098803 | A1 | 4/2009 | Reinisch et al. | 450/39 |
| 2009/0171259 | A1 | 7/2009 | Soerensen et al. | 602/67 |
| 2010/0011481 | A1* | 1/2010 | Kipnes | 2/105 |
| 2010/0184355 | A1* | 7/2010 | Kennedy | 450/31 |

OTHER PUBLICATIONS

International Preliminary Report on Patentability dated May 16, 2012 corresponding to International Patent Application No. PCT/US11/24899.

* cited by examiner

GARMENT WITH SLIP-RESISTANT LINER

BACKGROUND OF THE INVENTION

1. Field of the Invention

The present disclosure relates to garments that have an inner liner. More particularly, the disclosure relates to garments that have an inner liner that is elasticized to provide a firm fit against the body of the wearer. Still more particularly, the disclosure relates to garments that have an inner liner that is elasticized and has a gripping edge that prevents slipping of the liner against the body of the wearer.

2. Description of Related Art

There exist many styles of outer garment that are designed to be loose fitting and comfortable. Such styles include tunics, tee-shirts, casual dresses and long swimming suit tops. While these garments are loose fitting and comfortable, many women still prefer or require a level of control in the abdominal region beneath such garments that the loose fitting garment necessarily does not provide. Often tee-shirts are worn beneath such garments; however, they are not designed to provide control or shaping of the body beneath the garment.

Accordingly, there is a need for a garment that has a liner that is shaped to provide control and shaping beneath the garment and will not slip against the body of the wearer during movement.

SUMMARY OF THE INVENTION

The present disclosure provides for a garment that has a liner that has a modulus of elasticity to provide control and shaping to the abdomen of the wearer and will not slip against the abdomen of the wearer.

The present disclosure also provides for a garment having a liner that remains taut against the abdomen of the wearer and has an edge having a non-slip material that prevents movement of the edge.

The present disclosure still further provides for a garment having a liner made from a control fabric that provides support to the wearer in the lower abdomen region, beneath the navel and above the pubic region of the wearer.

The present disclosure yet still further, provides for a garment having a liner made from a control fabric that has a non-slip material affixed thereto in the region of the abdomen beneath the navel to prevent slipping of the liner on abdomen of the wearer.

The present disclosure still yet further, provides for a garment having a liner made from a control fabric that has a non-slip material affixed thereto in a lower third of the line to place such non-slip material in the region between the navel and pubic region of the wearer.

The present disclosure still yet further, provides a garment having a liner including an elasticized band at its lower edge. The elasticized band has a non-slip material that anchors the liner in place against the abdomen of the wearer to prevent movement of the liner during wear.

The present disclosure further provides for a garment having an inner liner that is specifically shaped to be wider at the hip dimension than at the waist dimension while providing uniform control to offer an aesthetically pleasing shape to the wearer.

A garment having a liner including a tubular member having an opening at one end and an opening at an opposite end and a non-slip portion disposed proximate one of the openings.

A garment having a liner including a tubular member having an upper opening at one end and a lower opening at an opposite end and sides between the upper opening and the lower opening. A non-slip portion disposed proximate the lower opening that adheres to the abdomen of the wearer.

These and other benefits, features and advantages will be apparent from the following detailed description.

DETAILED DESCRIPTION OF THE DISCLOSURE

Figure 1:
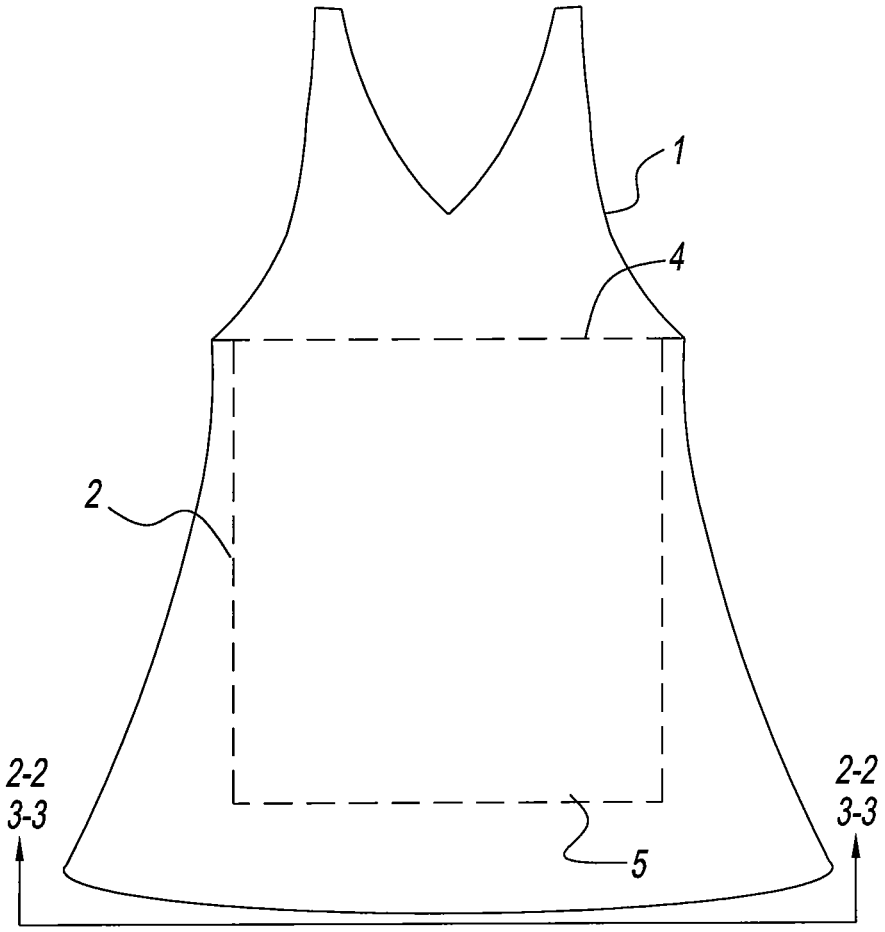
FIG. 1 illustrates a perspective view of a garment having a first embodiment of a liner according to the present disclosure.

Referring to FIG. 1, a liner according to a first embodiment of the present invention is shown and generally referenced by reference numeral 2. Liner 2 is disposed beneath an outer garment 1 such as, for example, a loose fitting garment that is sized to fit at or over the hips of the wearer. Liner 2 is a tubular member that has an upper opening 4 and a lower opening 5. It will be understood that liner 2 is in contact with abdomen of wearer and is disposed inside outer garment 1. While garment 1 is shown as being a swimming tank top, garment could also be a tunic or a t-shirt or any other such garment that is loose fitting. While liner 2 is described as being tubular, such liner may be knit on a warp or circular knitting machine. Alternatively, liner 2 may be a made using a cut and sew process from a wide fabric and have a straight sewn seam on at least one side between upper opening 4 and lower opening 5 to form a tubular member.

Figure 2:
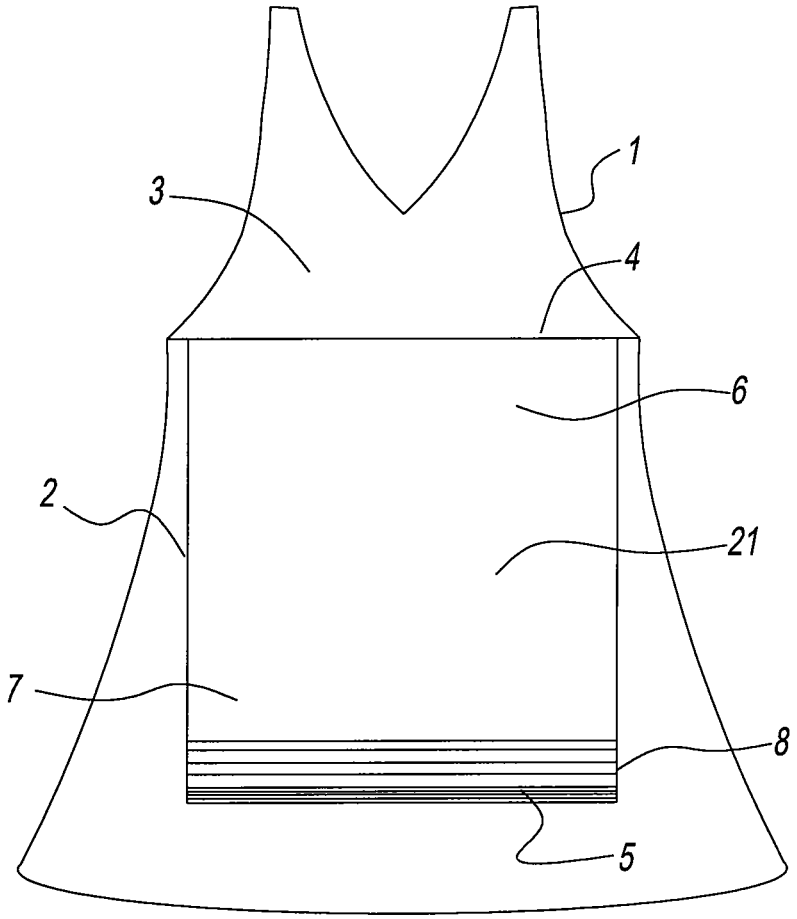
FIG. 2 illustrates a cross-section view of the garment showing liner and non-slip portion of FIG. 1 taken along line 2-2 of FIG. 1.

Referring to FIGS. 1 and 2, liner 2 has three regions. Liner 2 has an underbust region 6 that is attached to garment 1 beneath a breast-receiving area 3. At an opposite end of liner 2 from underbust region 6 is a hip region 7 that has a non-slip material 8 affixed thereto. Hip region 7 is disposed at a lower third of liner 2. Non-slip material 8 is preferably a material that has a degree of tack and will removably adhere to the skin of the wearer. Such material is preferably silicone, although other materials could also be used. Between underbust region 6 and hip region 7 is a waist region 21.

Underbust region 6, hip region 7 and waist region 21 each is preferably a third of the length of liner 2 and coincides with a particular region of the body of the wearer. Underbust region 6 surrounds the area of the body near the ribcage of the wearer. Waist region 21 coincides with the most narrow portion of the body at the waist of the wearer. Hip region 7 coincides with the lower abdomen of the wearer beneath the navel and above the pubic region of the wearer. Hip region 7 also surrounds the widest portion of the body at the hips of the wearer.

Liner 2 is made from a control fabric that provides shaping and contouring to the body of the wearer. Control fabric is an elastomeric material having a degree of stretch and modulus that exert a force on the body that will slim and shape the torso of the wearer. Modulus is the power of retraction of a fabric. Stretch and modulus are determined by the industry standard test method, ASTM D4964, at 20 pounds effective weight. Control fabric preferably has a stretch from 95% to 250%. Control fabric preferably has a modulus from 0.9 to 2.6 (pounds of holding power). The modulus readings are taken at 30% in the direction of the fabric to be used around the torso. While these ranges are preferable, other degrees of stretch and modulus that offer similar effect could also be used. Control fabric is preferably includes different fabrics. For example a fabric with a content of 69% nylon and 31% spandex, having a modulus of 2.8 pounds of holding power at 30% extension could be used as a control fabric. Alternatively, a fabric with a content of 77% nylon and 23% spandex having a modulus of 1.069 pounds of holding power at 30% extension is also an effective control fabric. Further, a fabric having a content of 44% nylon and 56% spandex, having a modulus of 2.13 pounds of holding power at 30% extension could be used as a control fabric.

The construction of liner 2 from control fabric ensures that each region of liner 2 will exert a high modulus against the surface of the wearer's body on which it rests. In particular, liner 2 will exert a high modulus against the abdomen, between the navel and the pubic region at the hip region 7 of liner 2. Non-slip material 8 will prevent hip region 7 from moving either laterally or vertically on the abdomen of the wearer during active movement. By being located in the lower third of liner 2, hip region 7 is anchored against the desired location of the abdomen, namely between the navel and the pubic area.

Figure 3:
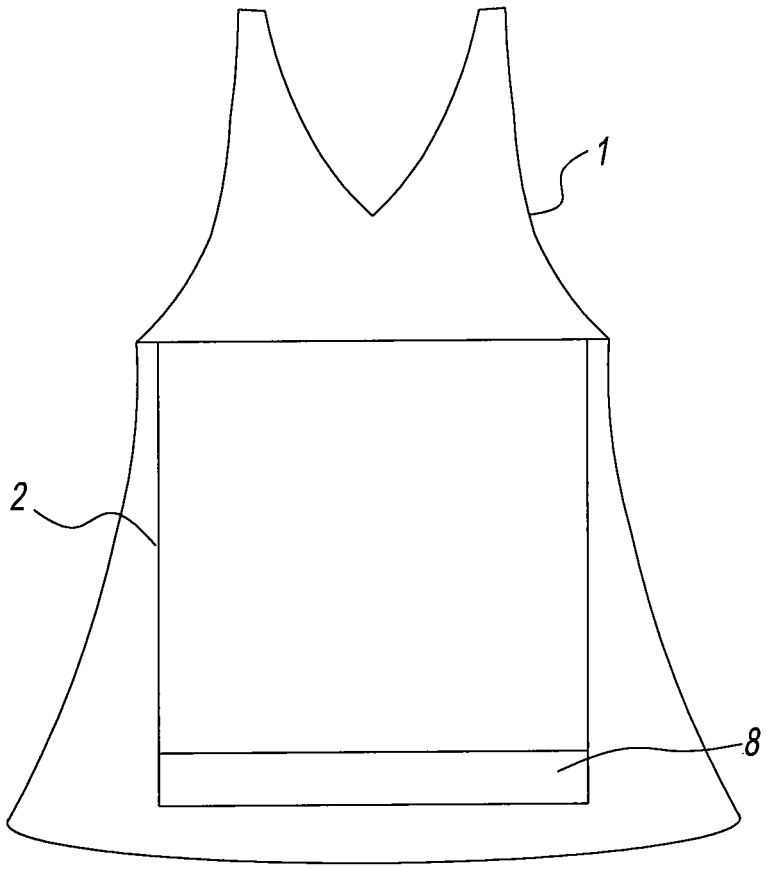
FIG. 3 illustrates a cross-section view of garment and liner of FIG. 1, showing an alternative non-slip portion taken along line 3-3 of FIG. 1.

Hip region 7 has multiple configurations. Hip region 7 is preferably covered by a solid band of non-slip material 8. Further, Hip region 7, preferably has rows of non-slip material 8 that alternate with uncovered fabric of hip region 7. Rows of non-slip material 8 and the uncovered fabric provide an irregular surface or a texture to hip region 7 to encourage adhesion to the abdomen. Referring to FIG. 3, hip region 7 alternatively has an elasticized band 23 near lower opening 5 that has non-slip material 8 affixed thereto to prevent movement of hip region 7 against abdomen of wearer.

Figure 4:
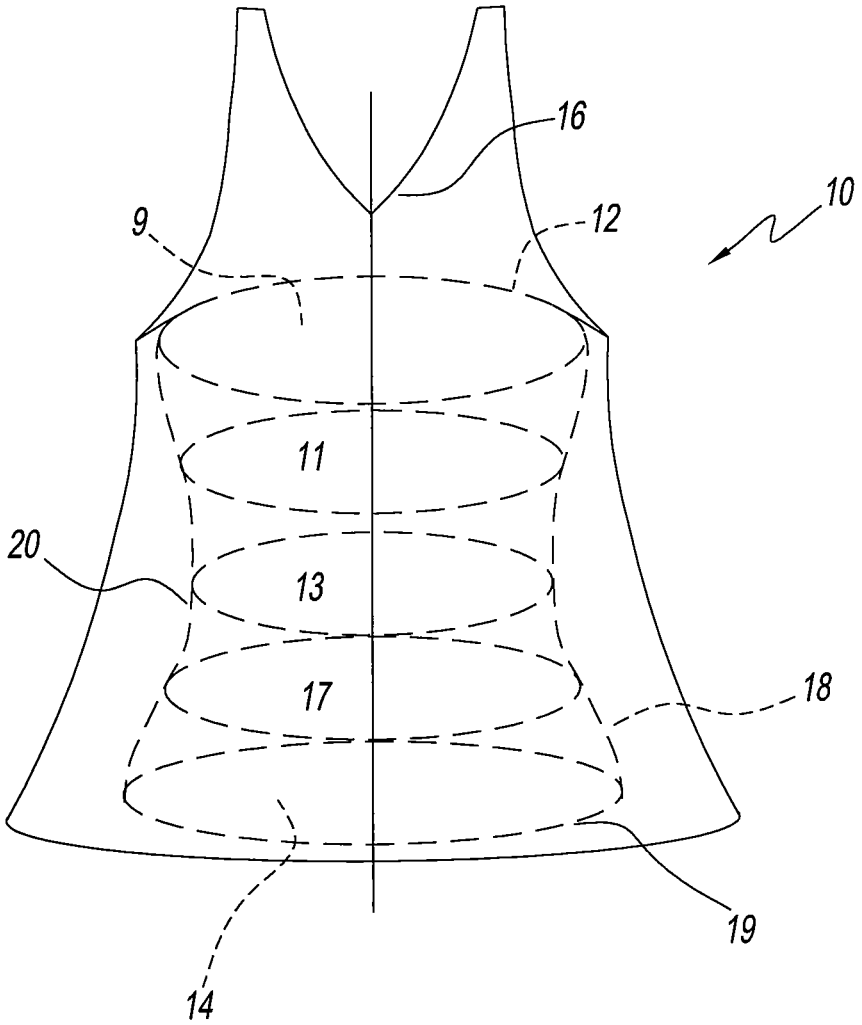
FIG. 4 illustrates a perspective view of a garment having a liner according to a second embodiment the present disclosure.

Referring to FIG. 4, a liner according a second embodiment of the present invention is shown and generally represented by reference numeral 20. Liner 20 is a tubular member and has an upper opening 9 that would be positioned beneath the bosom of a wearer. Upper opening 9 has an edge 12. Liner 20 has a lower opening 14 with an edge 19. Liner 20 has a longitudinal axis 16. Three cross-sectional areas, namely area 11, area 13, and area 17, for example, are perpendicular to longitudinal axis 16. Areas 11, 13, and 17 each has a different circumference and cross-sectional area due to curvature of lateral sides 18. Lateral sides 18 are concave between upper opening 9 and lower opening 14. Areas 11, 13, and 17 correspond to the underbust region beneath the ribcage, the waist, and the hips, respectively. To flatter and shape the figure of a wearer, a portion of liner 20 covering the hips is wider than other portions. These wider portions are preferably in the lower third of liner 20 or proximate edge 19 to accommodate the hips of the wearer and to provide firm control in the lower abdomen between the navel and the pubic area. While liner 2 is described as being tubular, such liner may be knit on a warp or circular knitting machine or have a straight seam on at least one side between upper opening 9 and lower opening 14.

Figure 5:
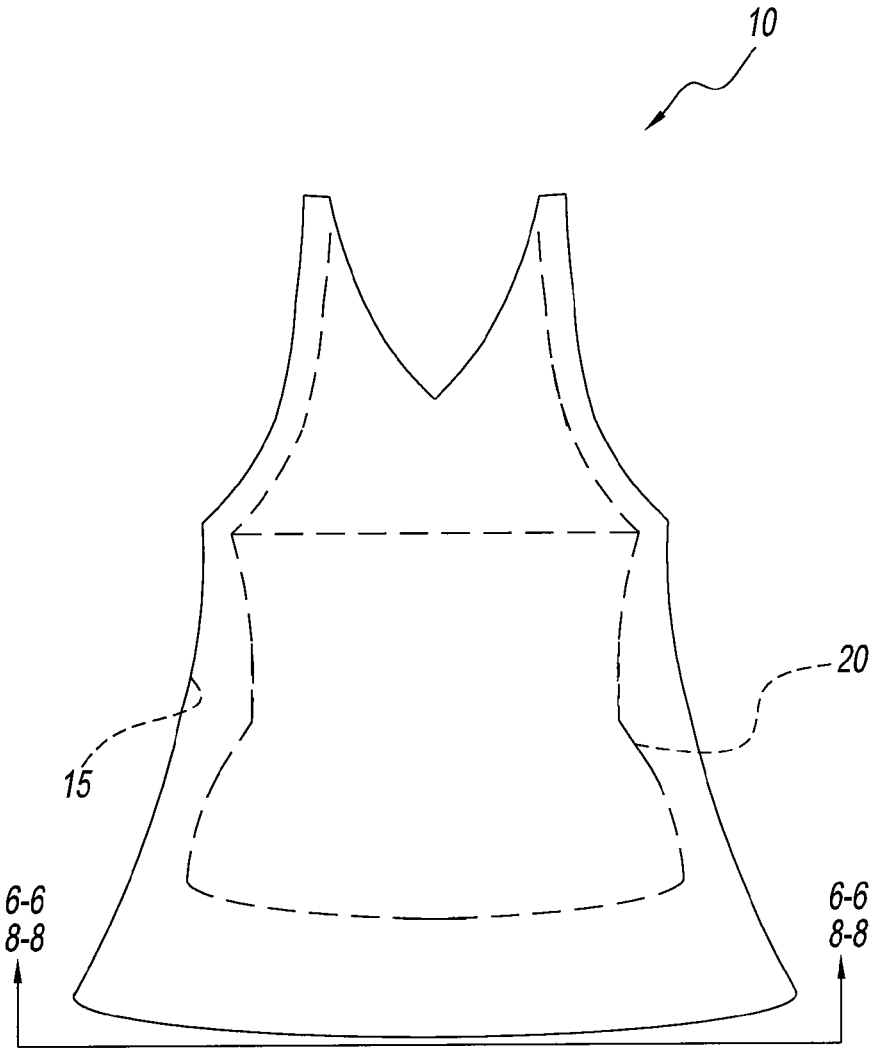
FIG. 5 illustrates a front view of the second embodiment of a garment according to the present disclosure.

Referring to FIG. 5, garment 10 is shown as a loose fitting garment, such as for example, a swimming tank top. Garment 10 is sized to fit at least over the hips of the wearer and to be loose fitting. Garment 10 has an outer fabric 15 and liner 20 disposed inside of outer fabric. It will be understood that liner 20 in contact with abdomen of wearer and is disposed inside outer fabric 15. While garment 10 is shown as being a swimming tank top, garment could also be a tunic or a t-shirt or any other such garment that is loose fitting.

Figure 6:
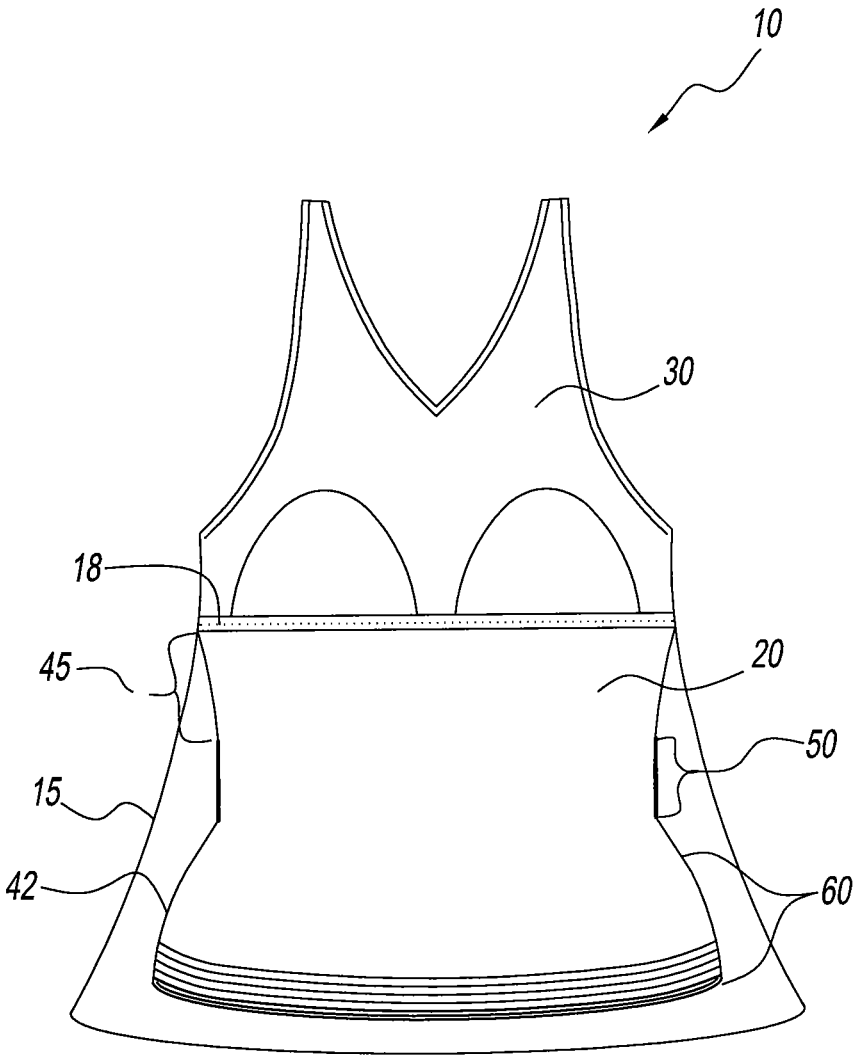
FIG. 6 illustrates a cross section view of the garment of FIG. 5, taken along line 6-6 of FIG. 5.
Figure 7:
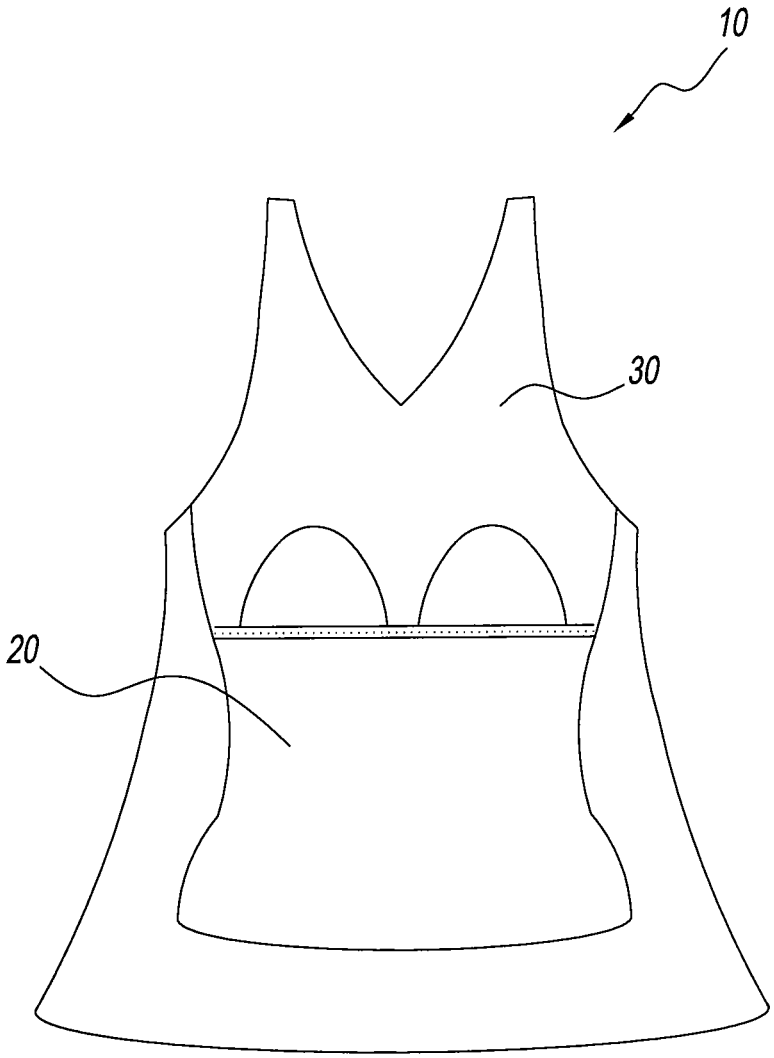
FIG. 7 illustrates a view of an alternative liner configuration of the garment of FIG. 4.

Referring to FIG. 6, liner 20 is preferably connected to an underbust seam 18 beneath a breast-receiving portion 30 of garment 10. Alternatively, as shown in FIG. 7, liner 20 is connected directly to breast-receiving portion 30 of garment 10. Breast-receiving portion 30 can include cups of any application and are not part of the inventive concept of the present disclosure. Liner 20 has three distinct regions that each preferably comprises a third of the length of liner 20. Liner 20 remains taut against the body, and particularly, the abdomen of the wearer during wear and particularly during active movement.

Figure 8:
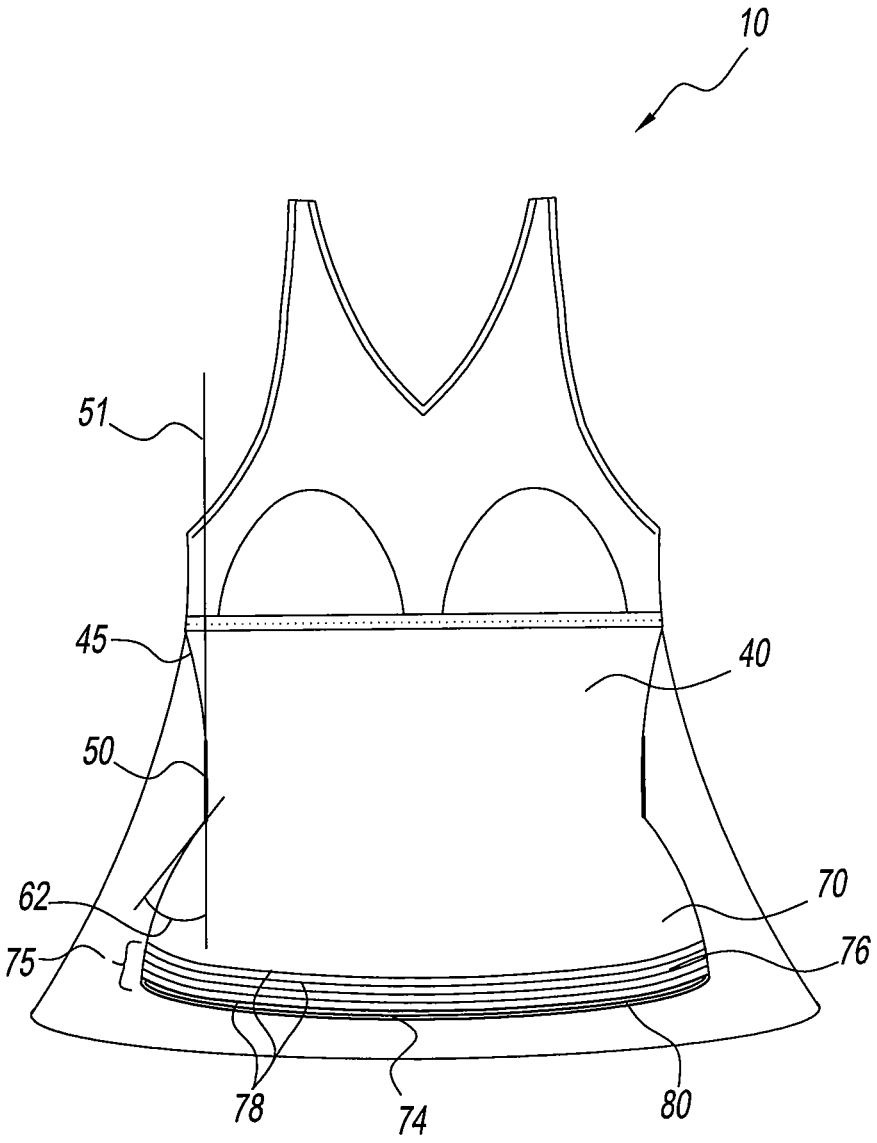
FIG. 8 illustrates a second cross-section view of the garment of FIG. 5, showing further details of the inside of the garment of FIG. 5, taken along line 8-8.

Referring to FIGS. 6 and 8, liner 20 completely surrounds the abdomen of the wearer. Liner 20 has lateral sides 42 on opposite sides of garment 10 beneath the armholes that have a contoured shape. Liner 20 has three distinct regions. Underbust region 45 is a tapered region immediately beneath underbust seam 18 (or breast receiving portion 30 of FIG. 7). Waist region 50 is a generally cylindrically shaped region immediately beneath underbust region 45. Hip region 60 is located immediately beneath waist region 50 and lies against the lower abdomen of the wearer beneath the navel and above the pubic area.

Underbust region 45 lies against the ribcage of the wearer and extends in a direction towards the waist. Underbust region 45 is tapered at an angle to slim the portion of the abdomen of the wearer beneath the ribcage and above the navel. Modulus of liner 20 permits underbust region 45 to lie firmly against the ribcage and to contour the abdomen towards the waist.

Waist region 50 has substantially parallel, as intended to be parallel, opposing sides to form a tubular or cylindrical region. Waist region 50 is immediately beneath underbust region 45. Modulus of liner 20 permits waist region 50 to slim the waist in the region of the abdomen near the navel. The tubular shape of waist region 50 does not constrict wearer in such a manner that would cause discomfort or an unflattering appearance. Accordingly, waist region 50 provides comfort and firm control at the narrowest portion of the body to provide an hourglass figure to the wearer.

Referring to FIGS. 6 through 8, hip region 60 is located immediately beneath waist region 50 and lies against the lower abdomen of the wearer above the pubic region. Hip region 60 has sides 65 that are flaired and has an angle 62 relative to a vertical line 51 coincident with waist region 50. Sides 65 lie at an angle of from 30° to 40° relative to vertical line 51 of waist region 50. Sides 65 flair to contour the anatomical shape, particularly the hips, of a woman's body. If liner 20 is of a tubular construction, the liner would have a tendency to fold or roll over on itself due to the width of the hips and the modulus of the fabric. Flaired sides 65 permit hip region 60, the widest portion of liner 20, to fully encircle the torso and to provide consistent modulus over the entire surface of the liner.

Referring to FIG. 8, hip region 60 has an inner surface 70 in contact with the body of the wearer and a lower edge 80. Inner surface 70 has a non-slip portion 75 that extends to lower edge 80. Non-slip portion 75 has non-slip material 76 thereon. Non-slip material 76 is preferably silicone that has a degree of tack or adhesion to grip the skin of the abdomen of the wearer. Alternatively, non-slip material 76 would also adhere to the fabric in a separate bottom portion of the swimsuit or garment. Non-slip material 76 covers a width of 0.75 inches to 3 inches over non-slip portion. Such width of non-slip material 76 ensures sufficient tack to prevent hip region 60 from changing position on abdomen of the wearer. Further, non-slip portion 75 is located in the lower third of liner 20 at an opposite end from underbust region 45. By being located in the lower third of liner 20, the non-slip portion 75 will be anchored against the desired location of the abdomen, namely between the navel and the pubic area.

Non-slip material 76 ensures that entire liner 20 and, in particular, hip region 60 will not roll over itself due to the modulus of material 40. Although, silicone is the preferred material of non-slip portion 75, other materials could also be used that provide the same gripping capability. Such alternative materials include elastic strapping with silicone coating, elastic strapping with exposed elastic and other similar combinations of materials that offer similar functionality.

Non-slip portion 75 can have multiple configurations. Edge 80 of non-slip portion 75 is preferably covered by a solid band 74 of non-slip material 76. Solid band 74 will anchor non-slip portion 75 to the skin between the navel and the pubic region of the wearer and prevent movement. Further, non-slip portion 75 preferably has rows of non-slip material 76 that alternate with uncovered fabric of non-slip portion. Rows of non-slip material 76 and the uncovered fabric provide an irregular surface or a texture to non-slip portion 75 to encourage adhesion to the abdomen. For example, non-slip portion 75 can have a decorative, waved or patterned texture that provides areas that are covered with non-slip material 76 and those that are not. Preferably 25% of non-slip portion 75 is covered with non-slip material.

Three regions, namely, underbust region 45, waist region 55 and hip region 60 function to provide not only control to torso, but also an aesthetically pleasing hourglass appearance due to modulus of liner 20.

Figure 9:
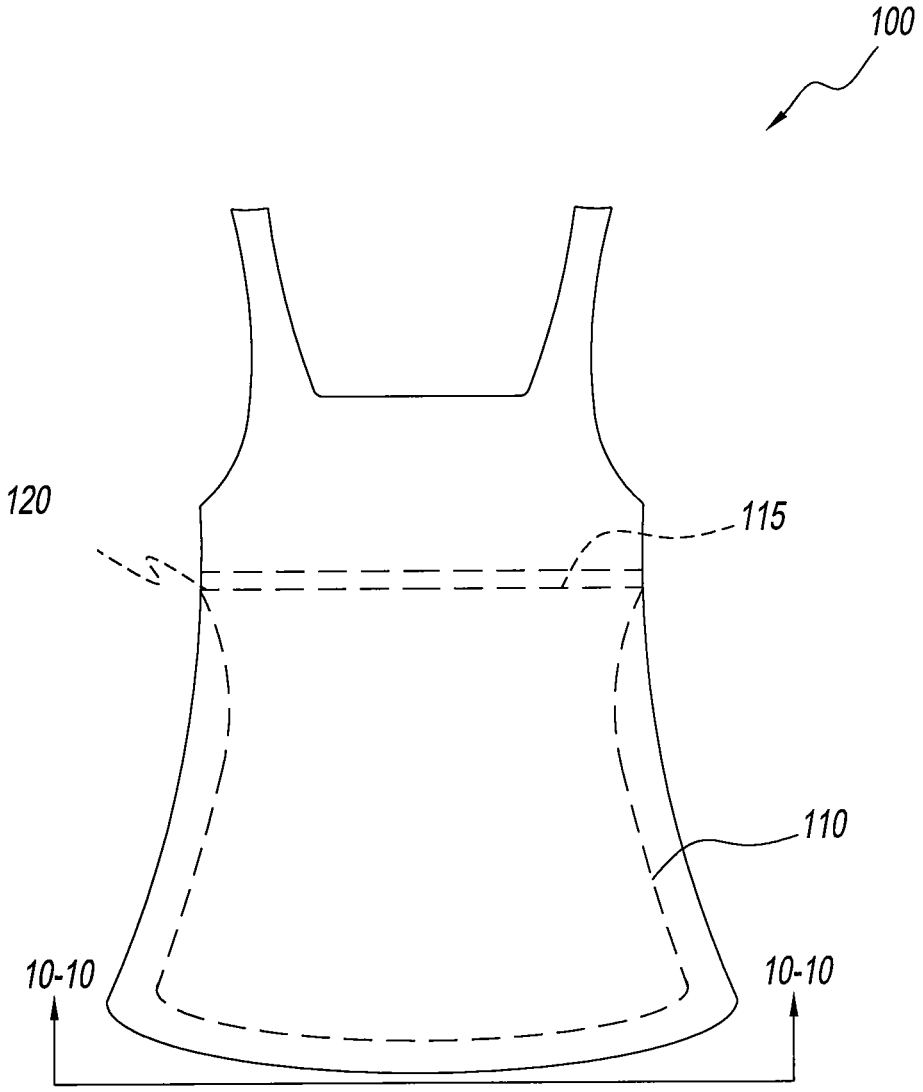
FIG. 9 illustrates a third embodiment of the garment according to the present disclosure.

Referring to FIG. 9 a third embodiment of the garment is shown and is generally referenced using reference numeral 100. Garment 100 is shown as a loose fitting garment, such as for example, a swimming tank top. Garment 100 is sized to fit at least over the hips of the wearer and to be loose fitting. Garment 100 has a liner 110.

Figure 10:
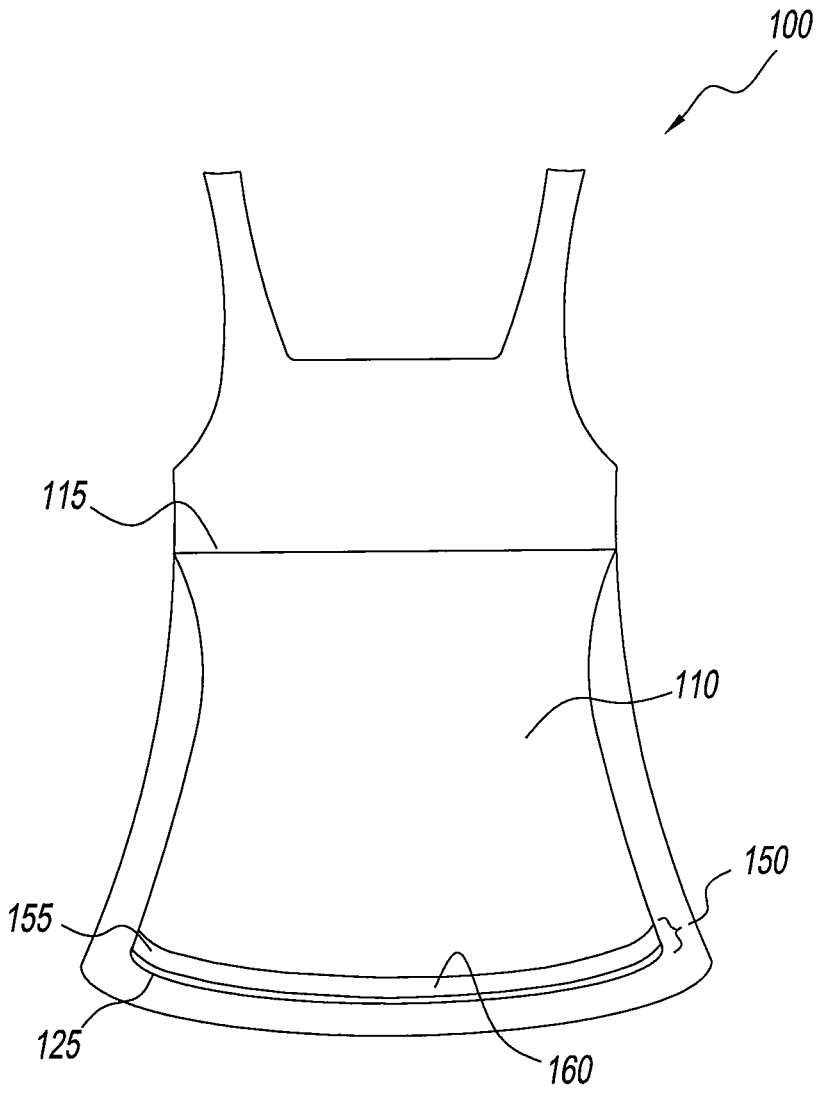
FIG. 10 illustrates a cross-section view of the garment of FIG. 9, taken along line 10-10 of FIG. 9.

Referring to FIG. 10, liner 110 has an upper edge 115 and a lower edge 125. Upper edge 115 is preferably secured to an underbust seam 120. Liner 110 is made from the same control fabric described above with respect to the first embodiment.

Referring to FIG. 10, lower edge 125 is secured to a non-slip region 150. Non-slip region 150 has a width of 0.375 inches to 1.5 inches measured in a direction from lower edge 125 towards upper edge 115. Non-slip region 150 includes an elasticized band 155. A non-slip material 160 is affixed to elasticized band 155. Elasticized band 155 is attached to garment 110. Elasticized band 155 has a stretch of 90% to 150%. The modulus ensures that liner 110 together with elasticized band 155 with non-slip material remains taut against abdomen of wearer.

Non-slip region 150 is specifically located on liner 110 to lie against the lower abdomen of the wearer between the navel and the pubic region. This is ensured by being located at the lower edge of liner 110 and by having a width of from 0.375 to 1.5 inches. The width non-slip region 150 maintains a taut fit of liner 110 around the hips and against the abdomen of women of a range of heights. By lying in this region of the abdomen, the modulus of liner 110 the modulus of elasticized band 155 in non-slip region 150 will provide control and support. Additionally, non-slip material 160 affixed to elasticized band 155 will prevent non-slip region 150 from rolling over itself over the hips.

While the present disclosure has been described with reference to particular embodiments, it should be understood that the embodiments are illustrative and that the scope of the disclosure is not limited to these embodiments. Many variations, modifications, additions and improvements to the embodiments described above are possible. It is contemplated that these variations, modifications, additions and improvements fall within the scope of the disclosure as detailed within the following claims.

We claim:

1. A garment having a liner, wherein the liner comprises:

a knitted tubular member with a modulus, said tubular member comprising:

an underbust region with an opening at one end;

a hip region at an end of said tubular member opposite said underbust region, wherein said hip region has a second opening and an inside surface;

a waist region between said underbust region and said hip region, wherein said hip region is immediately beneath said waist region and lies against a lower abdomen of a wearer; and a non-slip material that is disposed on a portion of the inside surface of said hip region, wherein said non-slip material is made of a different material than said tubular member;

wherein said non-slip material removably adheres to the lower abdomen of the wearer to hold the liner in position vertically and laterally and alone ensures the prevention of roll up of said hip region that normally occurs during movement of the wearer, wherein said waist region has lateral sides that are substantially parallel to a longitudinal axis of said tubular member, and wherein said hip region is at an angle of 30° to 40° relative to said lateral sides of said waist region.

2. The garment according to claim 1, wherein said tubular member further comprises a widest portion that has a variable cross-sectional area along said longitudinal axis, and said non-slip material is disposed at the widest portion of said tubular member that holds the liner in position on the abdomen of the wearer.

3. The garment according to claim 1, further comprising a layer of fabric connected to said tubular member, wherein said tubular member is disposed inside of said layer of fabric.

4. The garment according to claim 1, wherein said non-slip material is affixed to the inside surface.

5. The garment according to claim 1, wherein said non-slip material has a plurality of patterns on the inside surface selected from the group consisting of a band, a band and a plurality of rows, a wave pattern and a floral pattern and a dotted pattern, and any combination thereof.

6. The garment according to claim 1, wherein said non-slip material has a width of 0.75 inches to 3.0 inches.

7. The garment according to claim 1, wherein said hip region further comprises an elasticized band, wherein said non-slip material is affixed to said elasticized band.

8. The garment according to claim 7, wherein said non-slip material has a width of from 0.375 inches to 1.5 inches.

9. The garment according to claim 1, wherein said non-slip material is selected from the group consisting of silicone, silicone coated elastic, gripper elastic and any combinations thereof.

10. The garment according to claim 1, wherein said tubular member has a modulus of 0.9 to 2.6 pounds of holding power.

11. The garment according to claim 1, wherein said tubular member has a stretch of 95% to 250%.

12. The garment according to claim 1, wherein the garment is a tunic, a shirt, a swimming tank top or a tee-shirt.

13. The garment according to claim 1, wherein the garment further comprises a breast receiving region, and wherein said underbust region is connected to said breast receiving region.

14. The garment according to claim 1, wherein the garment further comprises an underbust seam, and said underbust region is connected to said underbust seam.

15. The garment according to claim 1, wherein said non-slip material is a lower third of said tubular member.

16. A garment having a liner, said liner comprising:

a tubular member having an underbust region, said tubular member having a modulus, said tubular member comprising:

a hip region at an end of said tubular member opposite said underbust region; and a waist region between said underbust region and said hip region, wherein said hip region of said tubular member comprises a non-slip material, and wherein said hip region is immediately beneath said waist region and lies against a lower abdomen of a wearer, wherein said non-slip material adheres to the abdomen of the wearer to hold the liner in position vertically and laterally on the abdomen during movement of the wearer and alone ensures the prevention of roll up of said hip region that normally occurs during movement of the wearer, wherein said waist region has lateral sides that are substantially parallel to a longitudinal axis of said tubular member, and wherein said hip region is at an angle of 30° to 40° relative to said lateral sides.

17. The garment according to claim 16, wherein said underbust region has an upper opening and said hip region has a lower opening, and wherein said upper opening is smaller than said lower opening.

18. The garment according to claim 16, wherein said hip region has an inside surface and said non-slip material is disposed on said inside surface.

19. The garment according to claim 17, wherein said lower opening comprises an elasticized band disposed on an inside surface of said lower opening.

20. The garment according to claim 16, wherein said tubular member comprises a control fabric having the modulus of 0.9 to 2.6 pounds of holding power and a stretch of 95% to 250%.

21. The garment according to claim 16, wherein said non-slip material is located along a third of said tubular member proximate to said lower opening.

22. The garment according to claim 17, wherein said tubular member further comprises sides between said upper opening and said lower opening, and wherein said sides are concave.

23. The garment according to claim 18, wherein said non-slip material is affixed to at least 25% of said inside surface of said hip region.

24. The garment according to claim 18, wherein said non-slip material is selected from the group consisting of silicone, silicone coated elastic, gripper elastic, and any combinations thereof.

25. The garment according to claim 19, wherein the stretch of the elasticized band ranges from 90% to 150%.

26. The garment according to claim 1 or 16, wherein said tubular member is knit on a warp or circular knitting machine.

27. The garment according to claim 1 or 16, wherein said tubular member is cut and sewn from a piece of wide fabric.

* * * * *